US006820683B1

(12) United States Patent
Hao

(10) Patent No.: US 6,820,683 B1
(45) Date of Patent: Nov. 23, 2004

(54) BUBBLE CYCLING HEAT EXCHANGER

(76) Inventor: Li Jia Hao, No. 2, Lane 127, Dang Ke St., Liu Tswo Sub-Ward, Kang Shan Jen, Kao Hsiung Hsien (TW)

( * ) Notice: Subject to any disclaimer, the term of this patent is extended or adjusted under 35 U.S.C. 154(b) by 0 days.

(21) Appl. No.: 09/477,285

(22) Filed: Jan. 4, 2000

(51) Int. Cl.[7] ..... F28D 15/00
(52) U.S. Cl. ..... 165/104.29; 165/104.26
(58) Field of Search ..... 165/104.26, 104.33, 165/104.29, 104.22, 104.23, 104.27, 104.32

(56) References Cited

U.S. PATENT DOCUMENTS 3,814,321 A * 6/1974 von Cube et al. ..... 165/104.22
4,625,790 A * 12/1986 Okayasu ..... 165/104.29
4,676,225 A * 6/1987 Bartera ..... 165/104.22
5,587,880 A * 12/1996 Phillips et al. ..... 165/104.29

FOREIGN PATENT DOCUMENTS

JP 0131876 * 10/1979 ..... 165/104.27

* cited by examiner

*Primary Examiner*—Ljiljana Ciric
(74) *Attorney, Agent, or Firm*—Rosenberg, Klein & Lee

(57) ABSTRACT

A bubble cycling heat exchanger comprises a sealing fluid loop, a heat absorbing source, a bubble generator, an expanding area for generating bubbles to be transferred to a fluid loop and a radiator. As one end of the seal loop is connected to the heat absorbing source, another end being connected to the radiator. The bubble generator is installed in the loop. Overheat will generate bubbles in the loop. As an unequilibrium occurs, the bubble will separate so that the fluid in the loop will flow to transfer heat, and thus heat is radiated from the radiator. As a result, the loop operating continuously until a heat equilibrium is achieved.

1 Claim, 12 Drawing Sheets

BUBBLE CYCLING HEAT EXCHANGER

FIELD OF THE INVENTION

The present invention relates to a bubble cycling heat exchanger, and especially to a heat exchanger, wherein in a sealed liquid tube, cool and hot waters will flow.

BACKGROUND OF THE INVENTION

A prior art heat pipe radiator includes a seal vacuum chamber filled with proper working fluid. A plurality of radiating fins are installed thereon. A capillary section is installed in the chamber. The heating way is to heat one end of the pipe to boil and evaporate the working fluid. The heat is transferred from a hot section at one side to a cold section at another side. After the gas is condensed to become liquid at the cold section. The liquid flows back due to gravitation or capillary force. Thus, due to the structure of the heat pipe, the amount of heat to be transferred will be deteriorated with the increment of an operation inclination. Due to the capillary force from the structure of the heat pipe, if overheat occurs, a dry out will be induced. Once dry out occurs, no liquid flows back so that the heating area is full of high temperature gas so that only gas phase exists. Therefore, temperature will increase dramatically so that heat supper conduction in the heat pipe fail and thus the effect is reduced greatly. Furthermore, the non-condensing gas in the heat pipe must be removed completely otherwise super conduction will be affected. Moreover, since an operation inclination exist, the heat pipe is possibly moved or folded. Accordingly, it is apparent that heat pipe has some original disadvantages necessary to be improved.

SUMMARY OF THE INVENTION

Accordingly, the primary object of the present invention is to provide a bubble cycling heat exchanger, wherein the vapor will expand so that bubble will separate and thus generate a push force. Thus, fluid in a seal loop will flow so as to transfer heat from a radiating section to a radiating section. Then, the fluid will flow back to the original position.

Another object of the present invention is to provide a bubble cycling heat exchanger. In the loop, according to the aforesaid operating temperature and pressure, a proper fluid is selected. An expanding area is formed in the loop so that generated vapor has a buffering space for containing fluid and protecting the liquid.

In order to achieve the above said objects, a bubble cycling heat exchanger is disclosed in the present invention. The bubble cycling heat exchanger of the present invention comprises a sealing fluid loop, a heat absorbing source, a bubble generator, an expanding area for generating bubbles for providing to a fluid loop and a radiator. As one end of the seal loop is connected to the heat absorbing source, another end will be connected to the radiator. The bubble generator is installed in the loop. Overheat will generate bubbles in the loop. As an unequilibrium occurs, the bubble will separate so that the fluid in the loop will flow so to transfer heat so that heat will be radiated from the radiator; the loop operating continuously until heat equilibrium is achieved.

The various objects and advantages of the present invention will be more readily understood from the following detailed description when read in conjunction with the appended drawing.

DETAILED DESCRIPTION OF THE PREFERRED EMBODIMENTS

Figure 10:
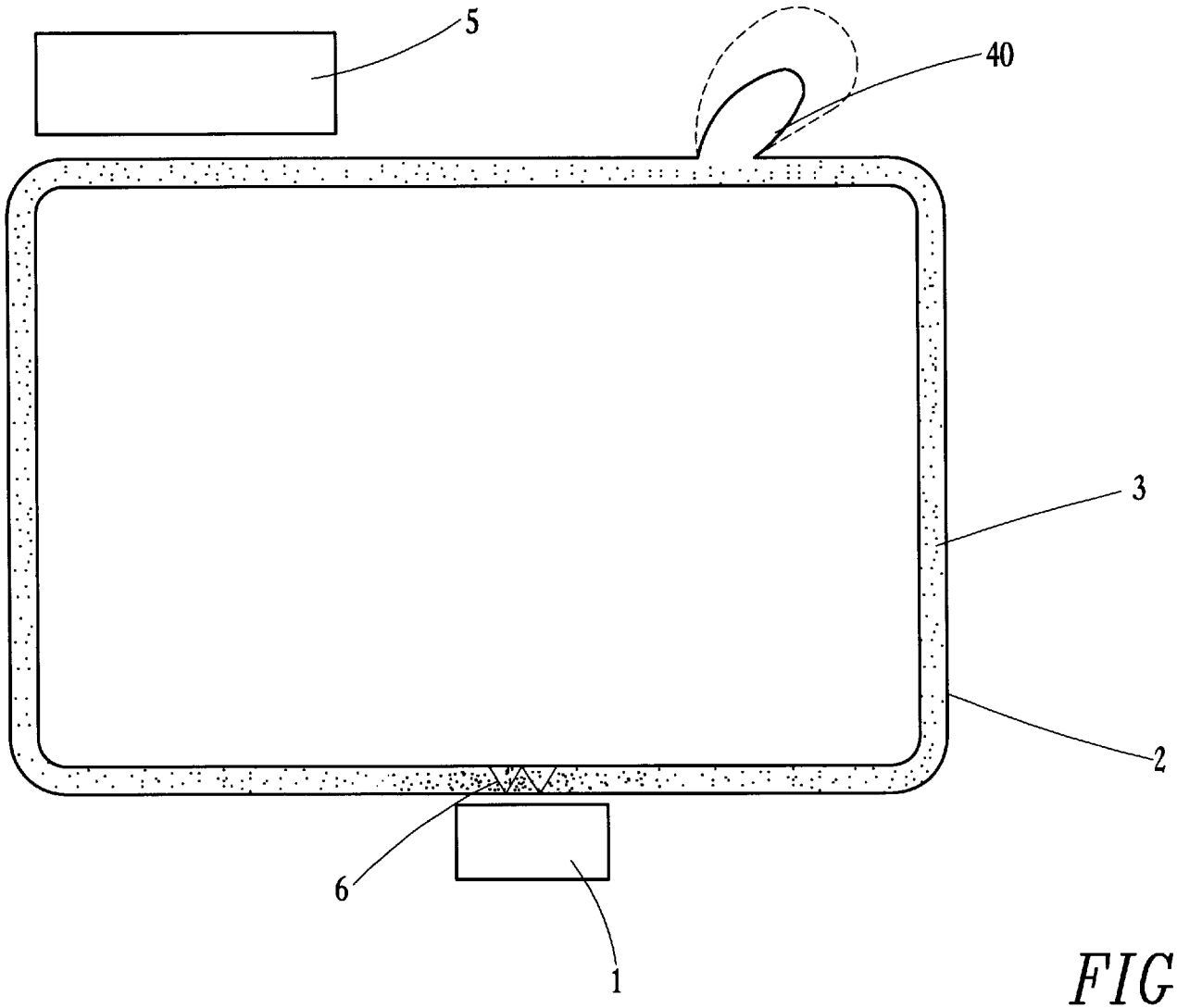
FIG. 10 is a schematic view of the ten embodiment according to the present invention.
Figure 11:
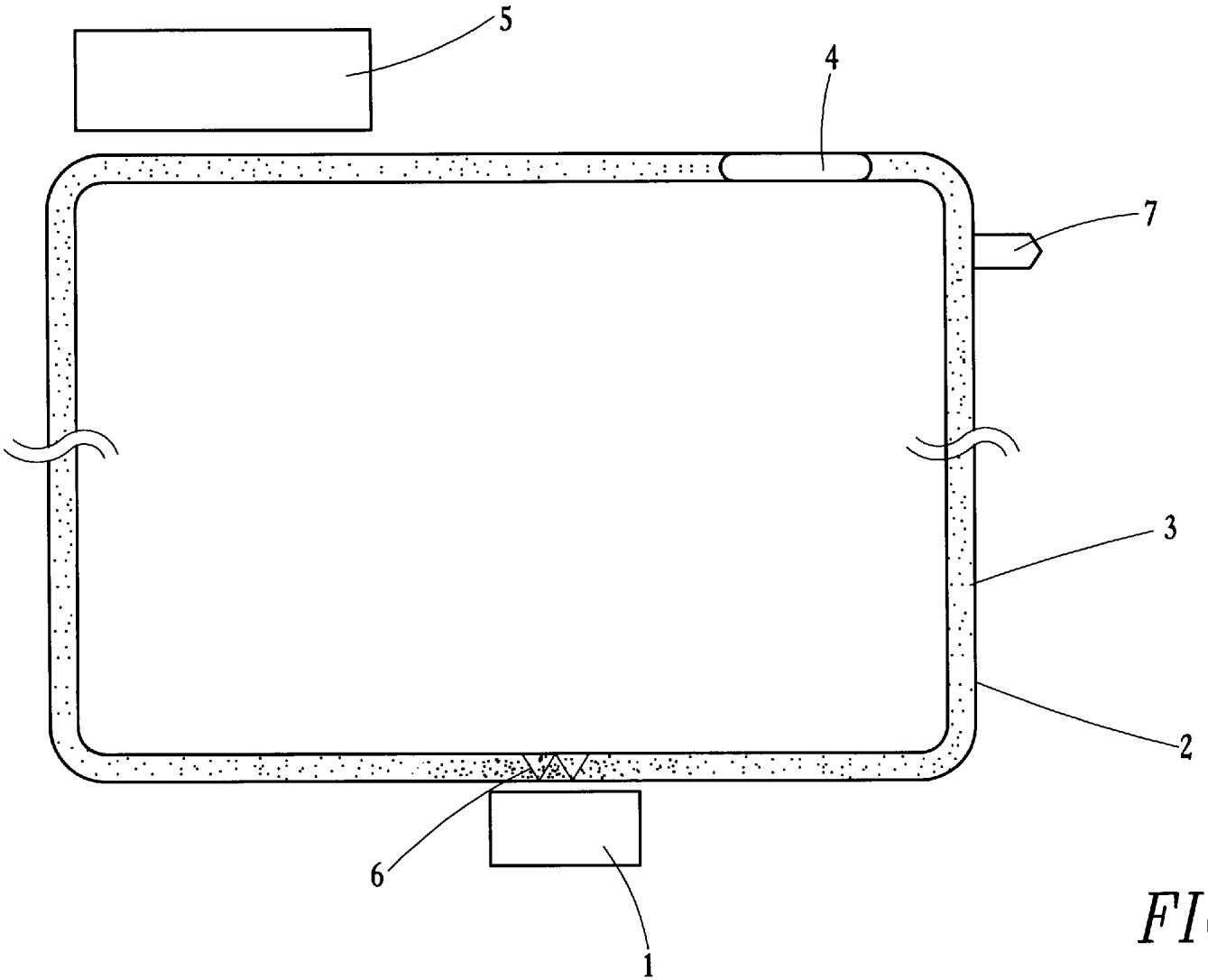
FIG. 11 is a schematic view of the eleven embodiment according to the present invention.
Figure 12:
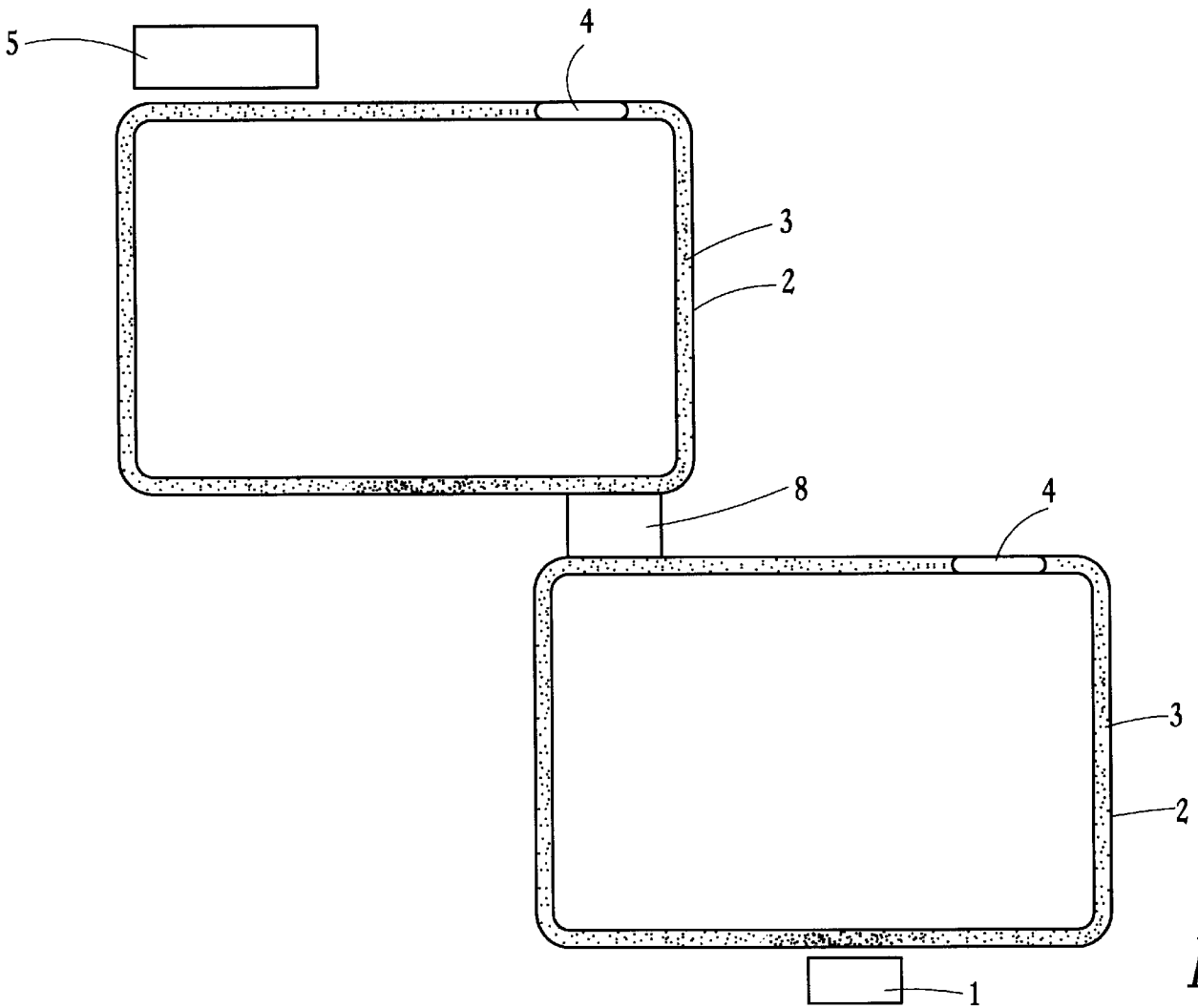
FIG. 12 is a schematic view of the twelve embodiment according to the present invention.

With reference to FIGS. 1 to 12, some embodiments about the bubble cycling heat exchanger of the present invention are illustrated. The bubble cycling heat exchanger of the present invention includes a closed flow loop 1 and a bubble generator 6, an expanding section 4 for providing liquid 3 to loop 2 for generating bubbles and a radiator 5. As one end of the closed loop 2 is connected to a heat source 1. Another end is connected to a radiator 5. The loop 2 has a bubble generator 6. Since overheat will cause the loop 2 to generate bubbles, as unequilibrium occurs, the bubble separates so that the liquid 3 in the loop flows to transfer heat. By the radiator 5, the heat will be conducted. The loop operates continuously until heat equilibrium is achieved. The aforesaid structure is illustrated in FIG. 11.

Figure 1:
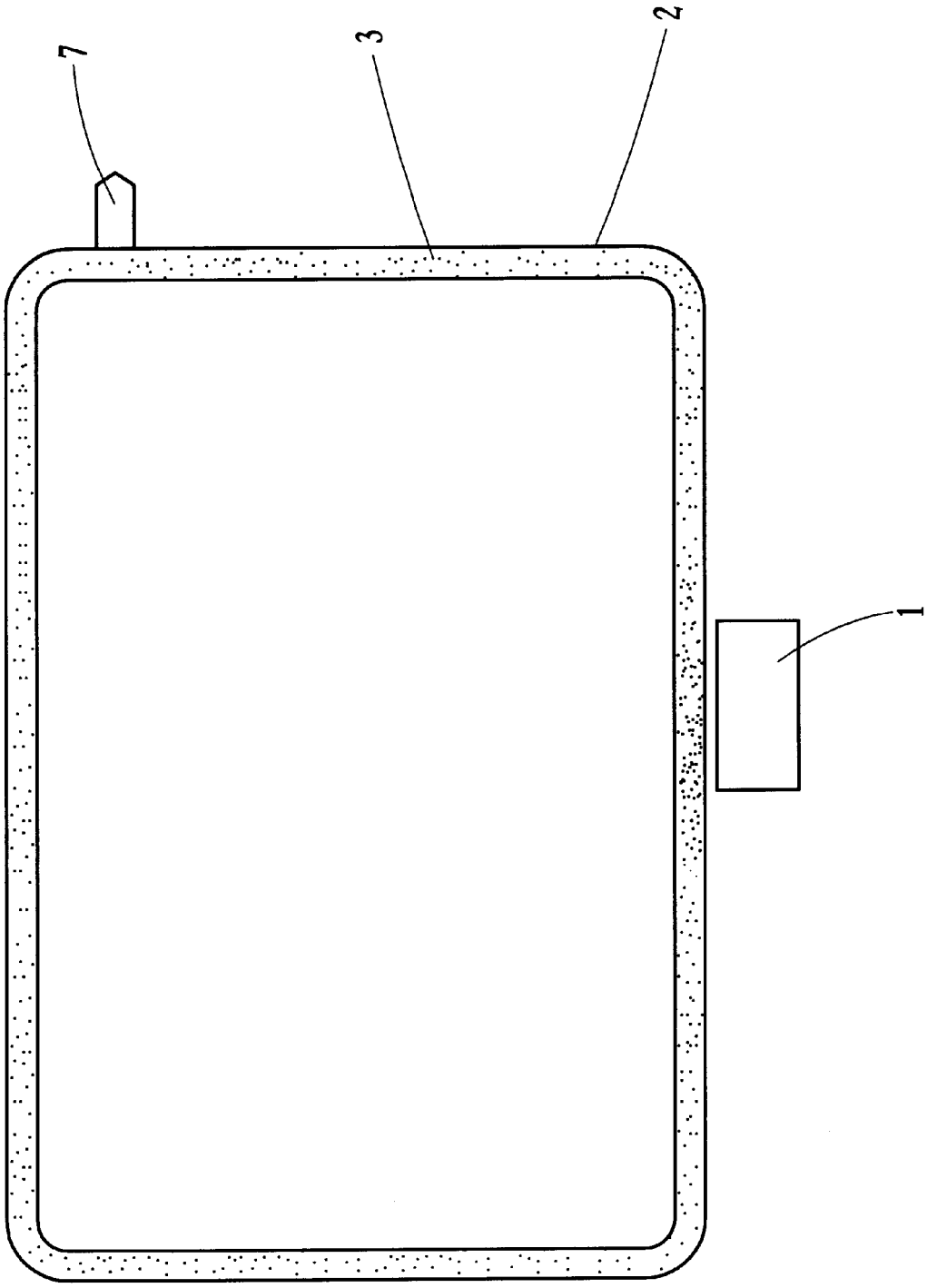
FIG. 1 is a schematic view of the first embodiment according to the present invention.
Figure 2:
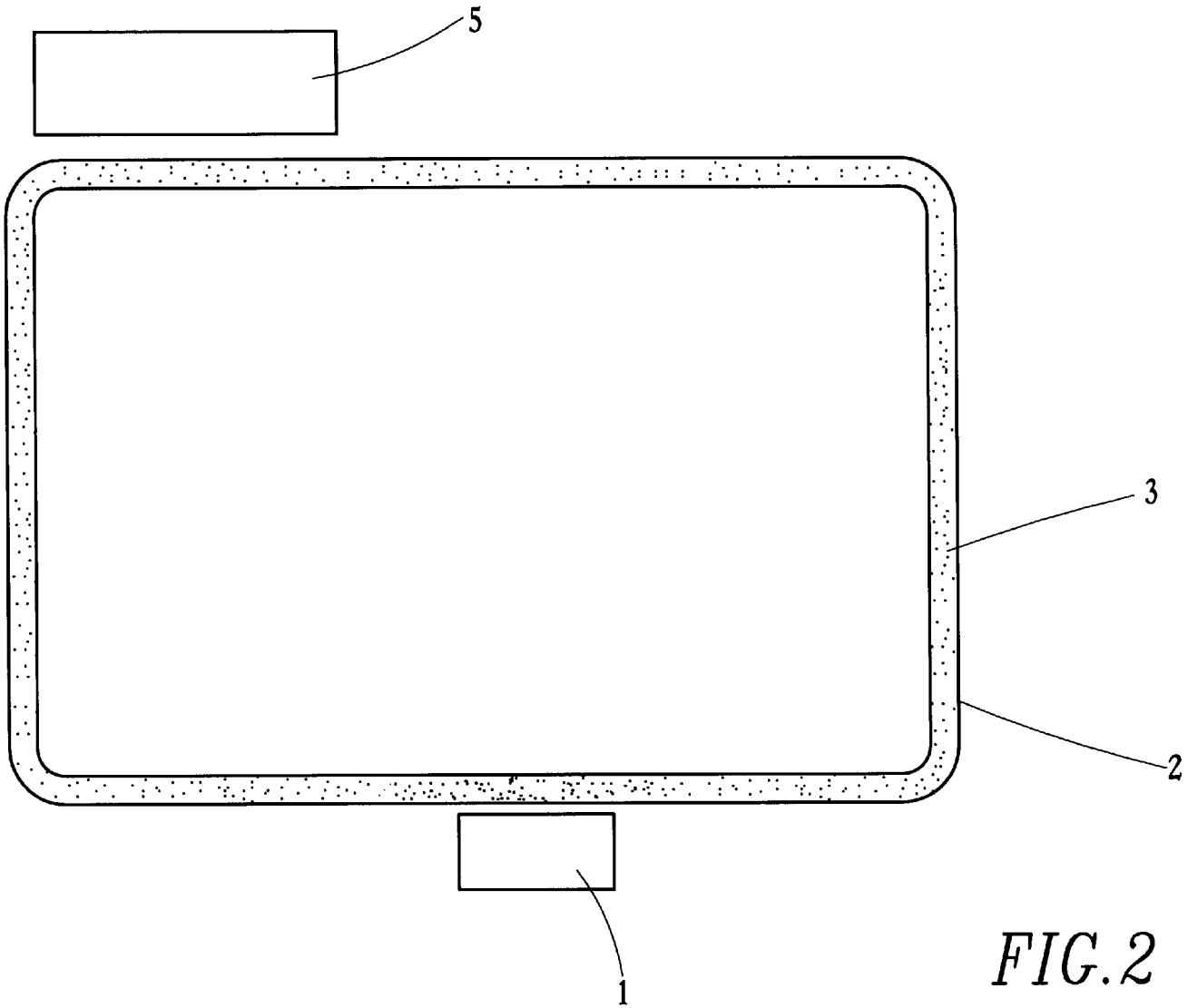
FIG. 2 is a schematic view of the second embodiment according to the present invention.
Figure 3:
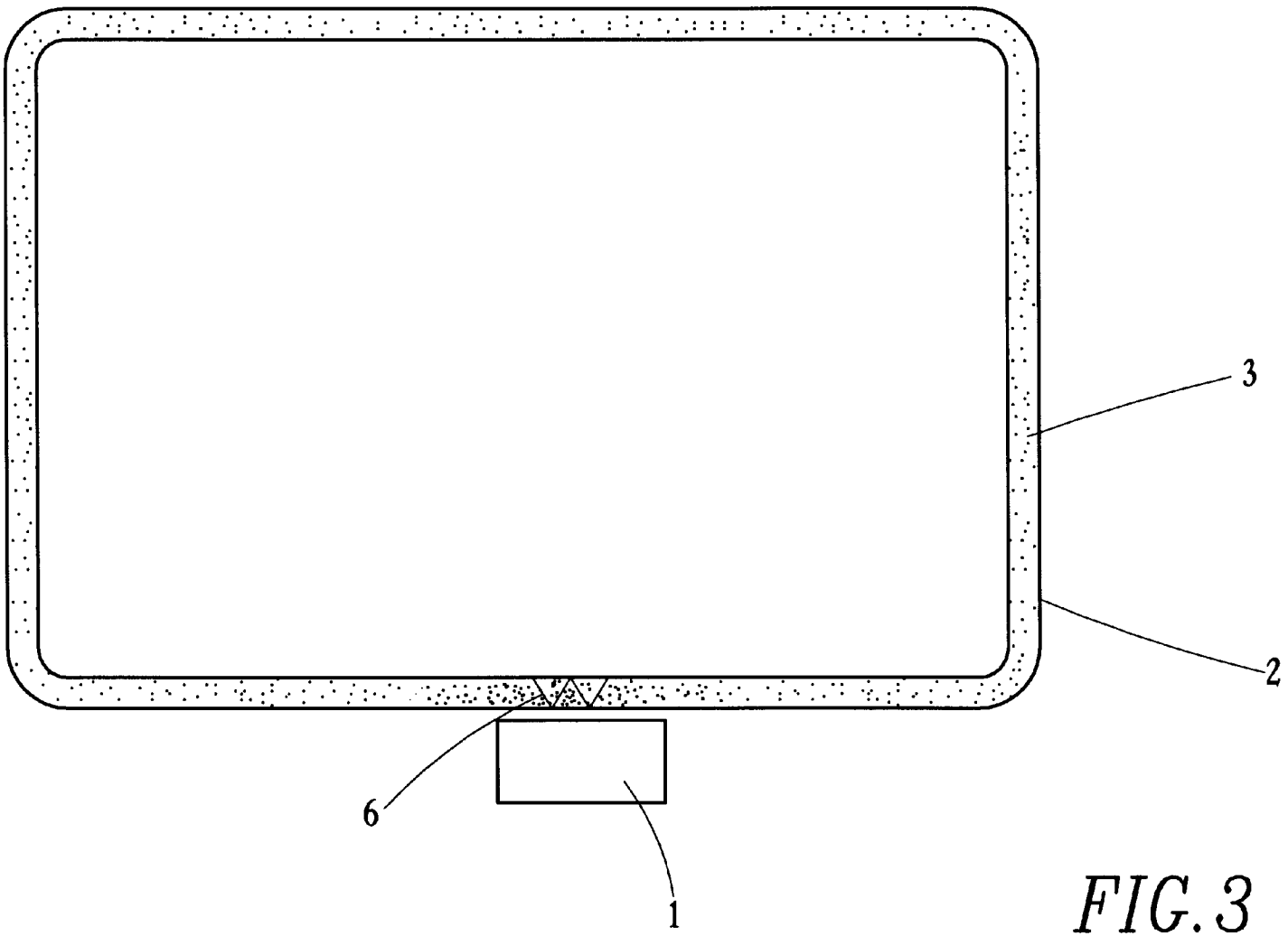
FIG. 3 is a schematic view of the third embodiment according to the present invention.
Figure 4:
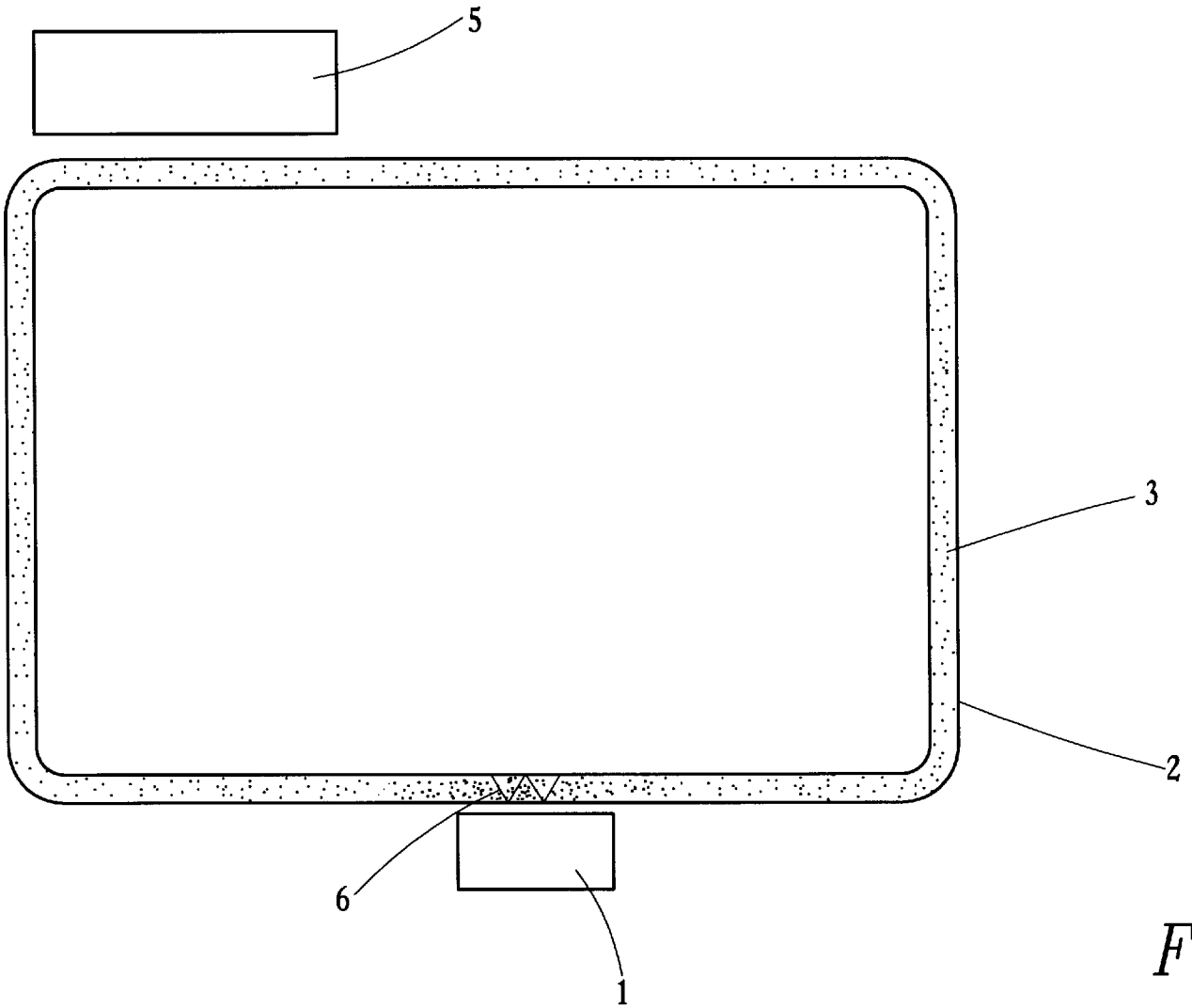
FIG. 4 is a schematic view of the fourth embodiment according to the present invention.
Figure 5:
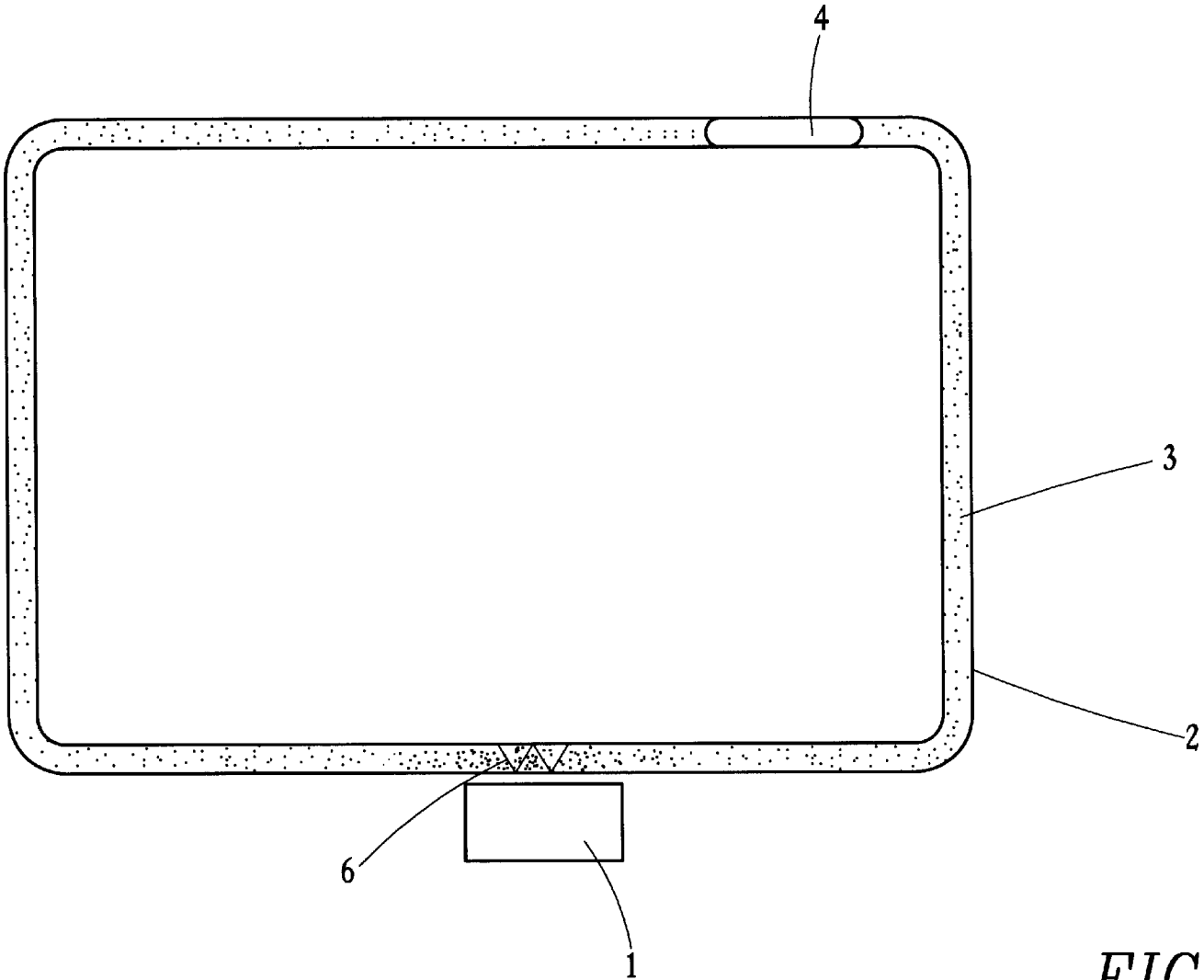
FIG. 5 is a schematic view of the five embodiment according to the present invention.
Figure 6:
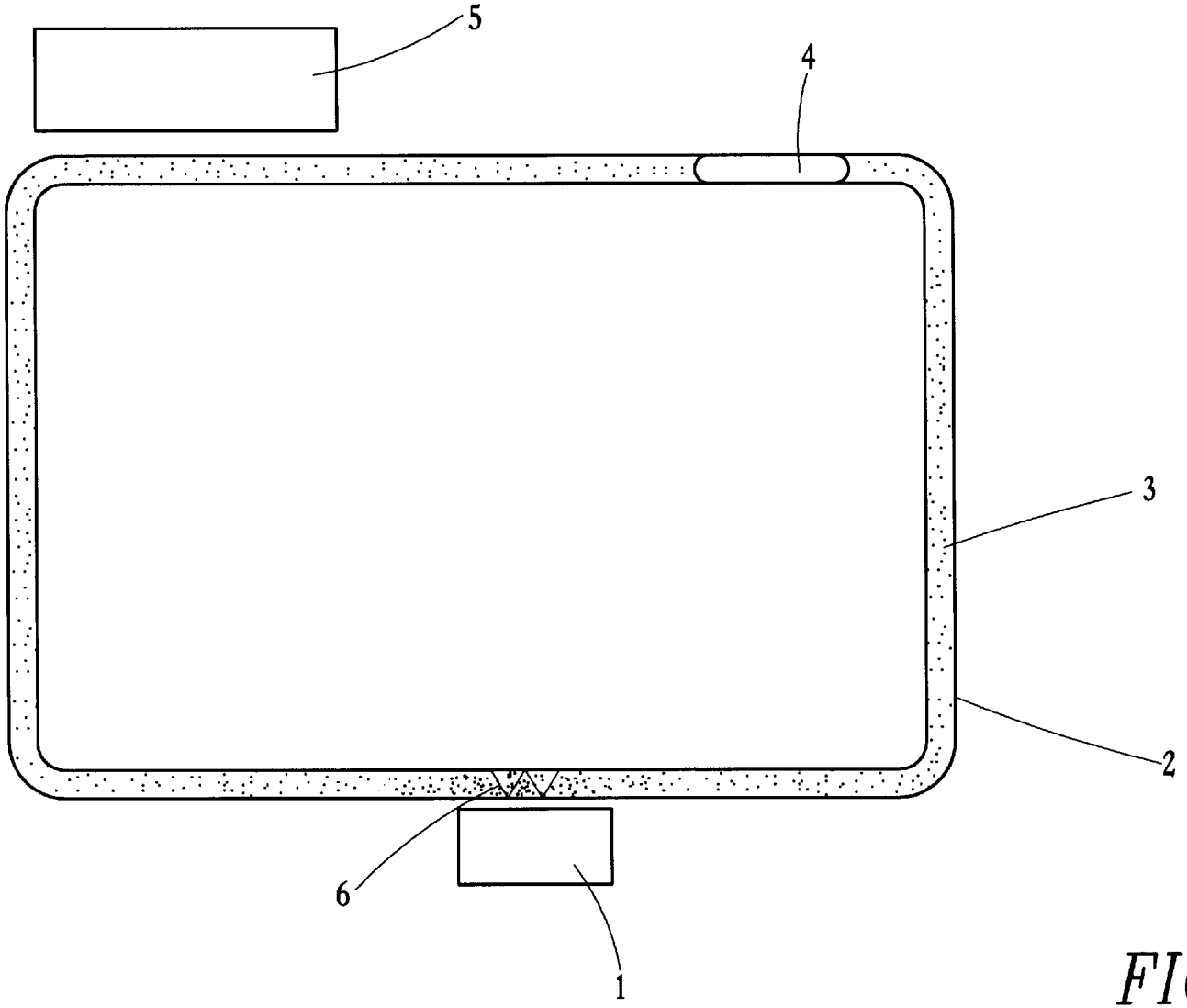
FIG. 6 is a schematic view of the six embodiment according to the present invention.
Figure 7:
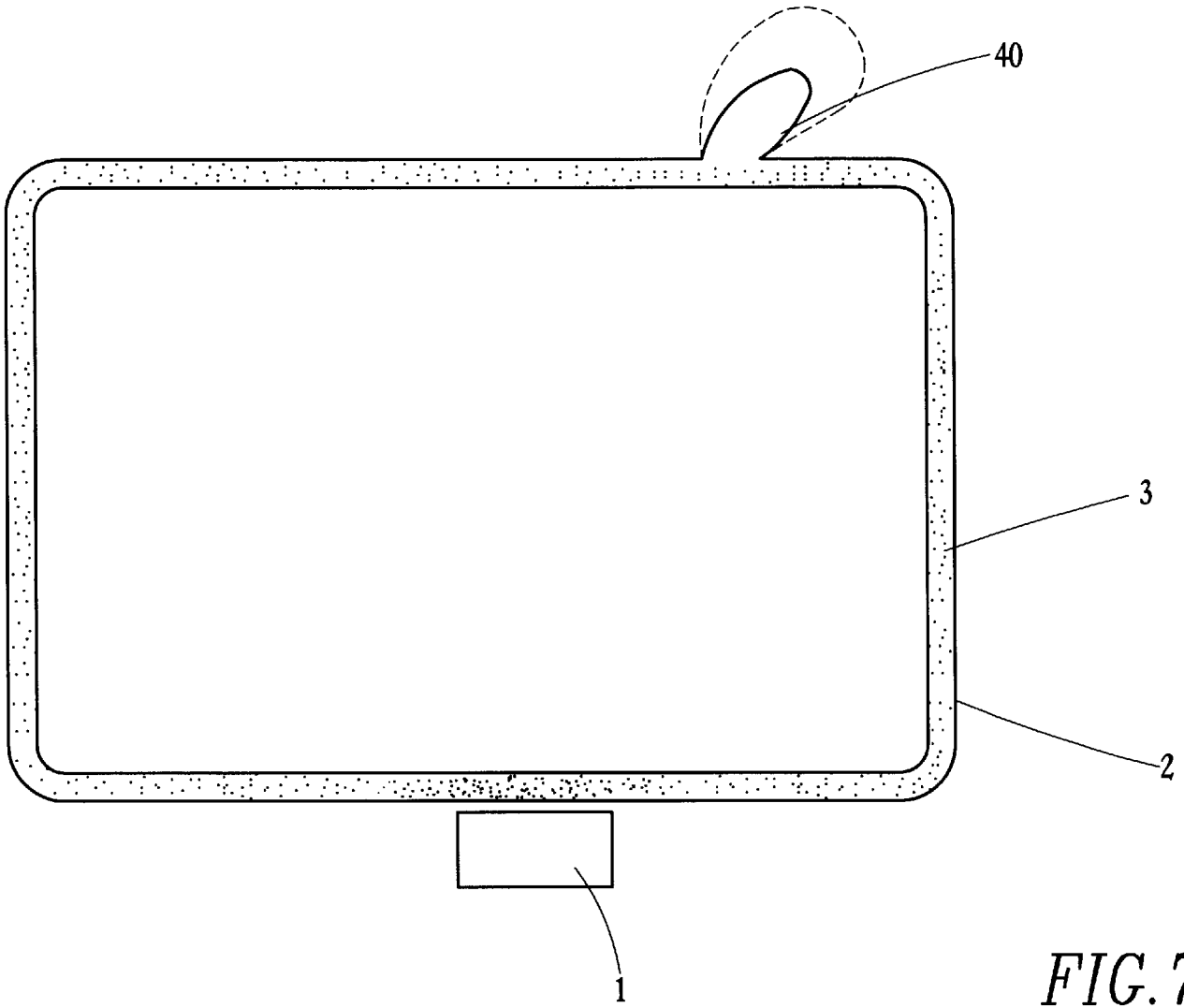
FIG. 7 is a schematic view of the seven embodiment according to the present invention.
Figure 8:
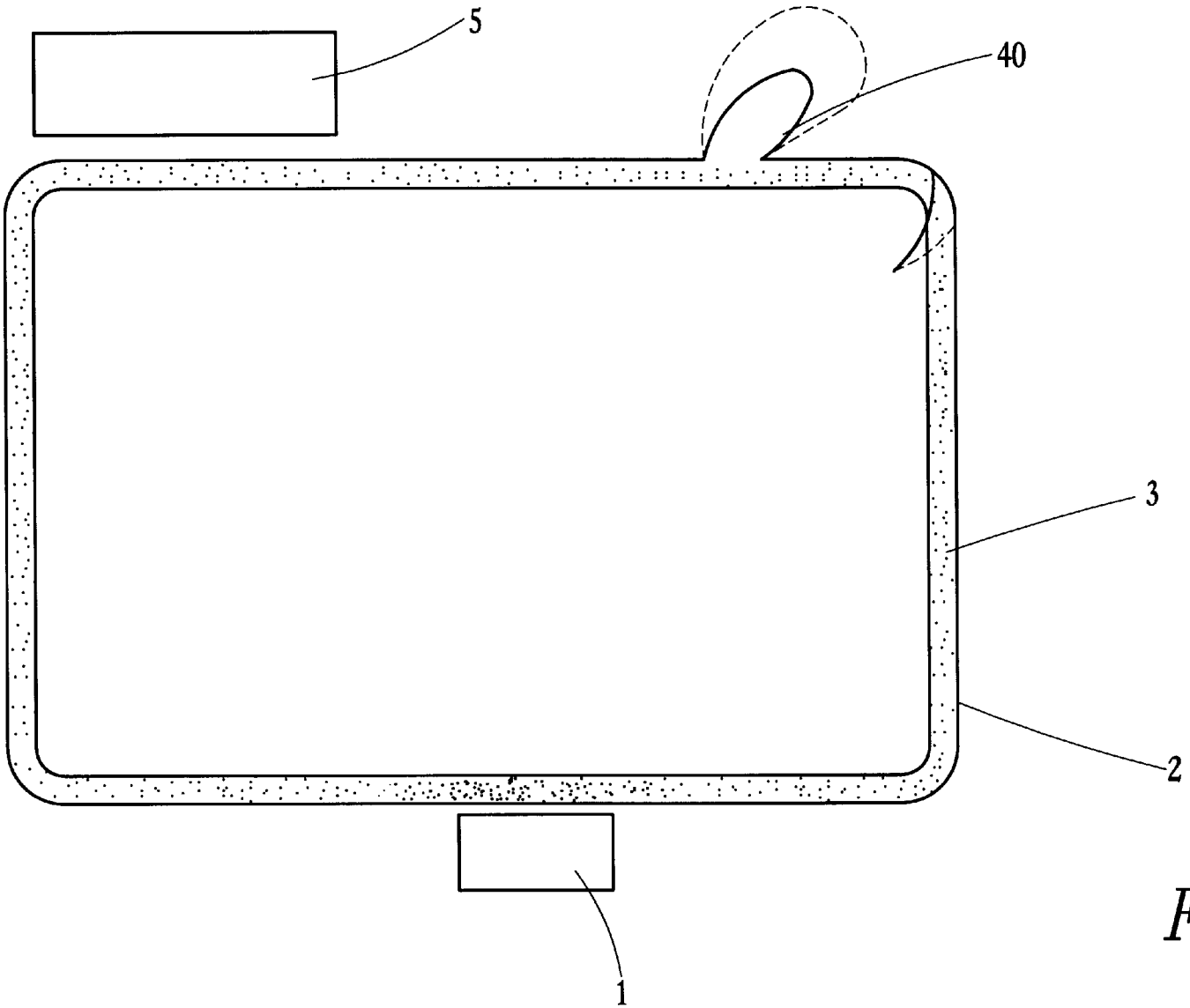
FIG. 8 is a schematic view of the eight embodiment according to the present invention.
Figure 9:
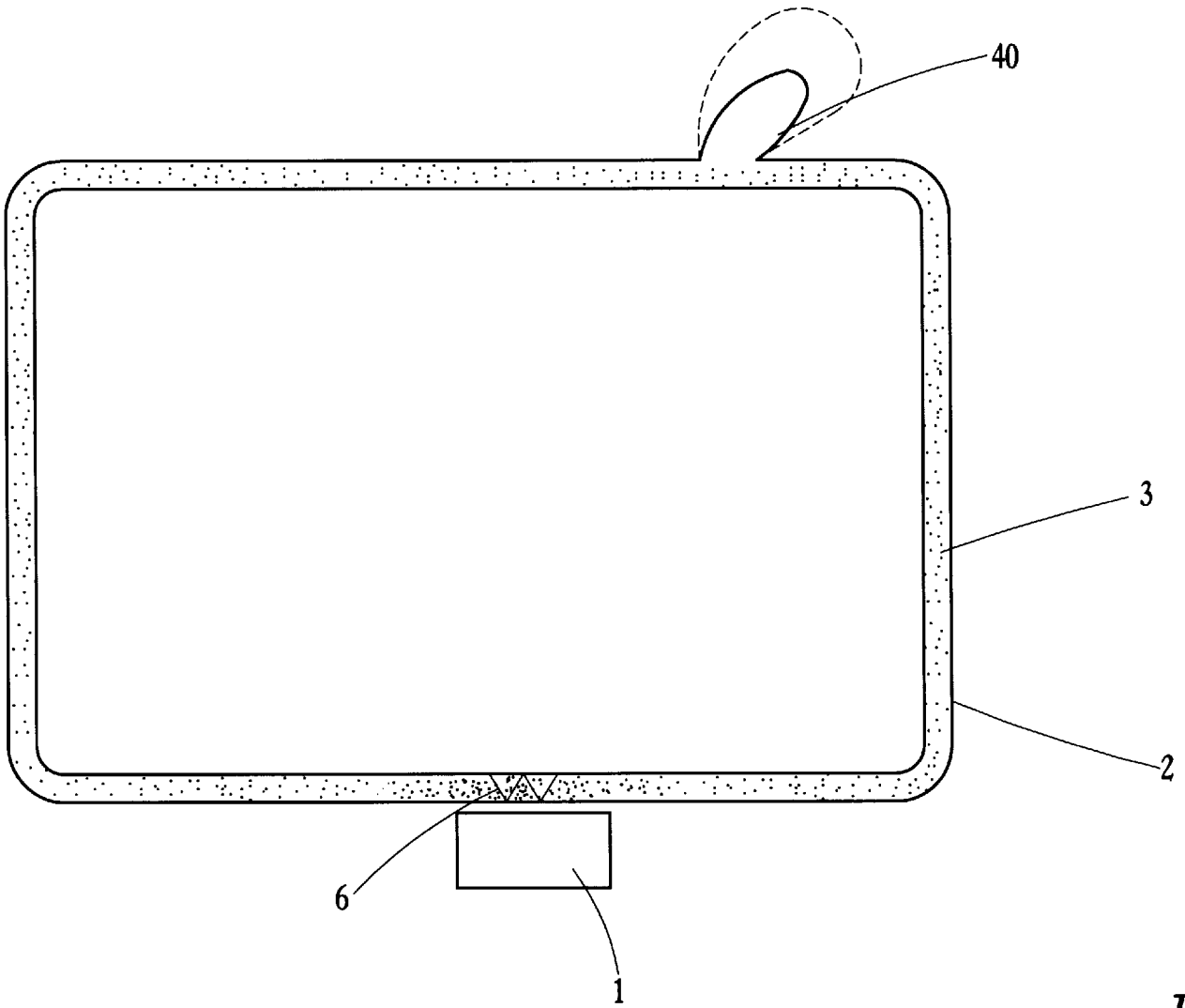
FIG. 9 is a schematic view of the nine embodiment according to the present invention.

FIG. 1 shows a simple embodiment of the present invention, wherein a heat absorbing source 1 and a loop 2 with liquid 3 are included. The radiator is the loop 2 itself. The length of the loop is not limited. The bubble generator is the loop having liquid. That in FIG. 2 different from those in FIG. 1 is a further radiator 5 is added. That in FIG. 3 different from those in FIG. 1 is a bubble generator 6 being extra installed near the heat absorbing source 6. That in FIG. 4 different from those in FIG. 2 is a bubble generator 6 being further added. That in FIG. 5 different from those in FIG. 3 is that an expanding area 4 for generating bubble is installed in the loop 2. That in FIG. 6 different from those in FIG. 4 is that an expanding area 4 for generating bubble is installed in the loop 2. That in FIG. 7 different from FIG. 1 is that an expanding chamber 40 connected to the loop 2 is installed. Therefore, liquid 3 is full in the loop 2. The expanding area 4 is formed aside the loop, which is elastic and thus can expand as a balloon, or an extending pipe is installed in order to have a space for containing the vapor. Comparing FIG. 8 with FIG. 2, the difference therebetween is an expanding chamber 40 connected to the loop 2. The different of FIG. 9 from FIG. 7 is a bubble generator 6 is further installed near the heat absorbing source 1. The difference of FIG. 10 from FIG. 8 is that a bubble generator 6 is installed near the heat absorbing source 1. Comparing FIG. 11 with FIG. 6, the difference therebetween is that the loop can be extended unlimitedly and an water inlet 7 is further arranged. This is necessary in the loop, while is not the most importance. The most important is that another aspect is disclosed in FIG. 12. Two loops are installed, one being directly contacted with the heat absorbing source 1. The heat absorbing source 1 in the loop 2 can be formed by multiple points. Then, the radiator of the loop 2 can be a heat transfer body 8. Heat is transferred to another loop through the heat transfer body 8. Thus, the object of heat dissipation is achieved by the radiator 5 in another loop 2. Therefore, a series connection conforming a specification is achieved. Therefore, production and assembly work can be performed conveniently. No special loop arrangement is required. Similarly, the same heat absorbing source can be installed with a plurality of loops connected in parallel.

The liquid in the loop can be selected according to the operating temperature and pressure. The loop can be exhausted to vacuum or not be exhausted to vacuum which is determined according to the kind of liquid or the temperature range for operation. Moreover, the loop may have any desired shape, material and combination to be rigid, flexible or the combination thereof. The loops can be connected in serial, or in parallel, or independently, or by multiple loops, or into a web, or the combinations of above structures.

The radiator is the loop itself or the liquid can be extended or prolonged to the place for heat exchanging, in the present invention, it is the radiator. The radiator can be connected with various kinds of the radiating device for heat exchanging. The bubble generator can be formed by the inner wall of the cross section of the loop with various shapes, or is embedding objects, or is the connections of pipes with different sizes, or is the loops connected in series or in parallel, or even is a net shape loop. The expanding area in the loop can be an expanding vapor space or reduced vapor space, which can be placed in the inner space of a loop with a proper size, i.e. the area without filling liquid completely in loop 2, or the expanding area is attached to the loop. (as shown in FIGS. 7 and 10). Of course, the expanding area does not be included. It is a device capable of deforming as a proper pressure is applied. Then, the liquid can be filled in the whole loop without including the expandable area. Therefore, a volume is provided for the vapor from heating the liquid within the loop in order to avoid the breakage of the loop.

The heat absorbing source of the loop may be connected to the loop by various known ways for heat transferring. The bubble generator in various kinds of loops can be installed at the heat absorbing source to be in contact with the loop. The same effect for generating bubbles is induced. The connection ways are various, such as gluing, welding, riveting, buckling, etc., or the combination thereof.

The loop must provide a structure for charging and sealing the system liquid. The inlet and sealing way may be changed according to the shape of the loop. It is only necessary that after liquid is injected, the whole loop is sealed. The inlet can be installed at proper place since the loop is designed as a liquid, each joint must be sealed for reducing draining of liquid. In the present invention, many sets of devices can be formed in parallel or in series. Finally, a thermal equilibrium of the system is achieved. Wherein the heat absorbing source can be a heating device, and the radiator is a cooling device, while the medium of heat transfer is liquid. The power for inducing a cycling is gas so that the loop system original in a static cooling condition will absorb heat and generate bubble from the radiator directly or indirectly so as to push the liquid within the liquid to flow toward an unequilibrium condition. The loop rotates continuously. By the loop at another side, the heat of the vapor is dissipated for cooling. After heat is dissipated, the liquid flows to the hot place for performing the following heat exchange cycle. Therefore, a sufficient heat exchanger is acquired, but the dry heating of the thermal pipe will not occur so that the thermal pipe has no effect. This will not occur in the present invention, since a large amount of liquid is filled in the loop of the present invention, this is absolutely different from that only a slight amount of liquid is in the thermal pipe. Since the prior art thermal pipe has a capillary effect and the operation orientation. However, the loop of the present invention can be very long and many radiators are installed. That is, the heat to be dissipated can be matched with proper designed radiators. The radiators can be designed in the same position, or different positions, or is the loop itself or at a special locations. The heat can be transferred to another places for heat exchanging and thus heat can be transferred to a farther end. The loops can be bent, arranged, and stacked. These features can not be attained by prior art designs.

In summary, in the present invention, a simple loop serves to perform a heat exchange of thermal cycle. It can be used to many structures, from a very small electronic element to a large power plant. Therefore, the present invention is good structure of thermal transfer.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A heat exchanger system comprising:

a sealed conduit defining an uninterrupted single closed fluid loop having a substantially constant fluid transport cross-sectional area and containing a fluid therein;

a heat source coupled externally to a first portion of said single closed fluid loop, said heat source being operable to heat at least said fluid passing through said first portion of said single closed fluid loop;

a bubble generator coupled to said first portion of said single closed fluid loop, said bubble generator having means to continuously generate a plurality of bubbles flowing with said fluid for actuating continuous flow thereof through the entirety of said single closed fluid loop at least until a heat equilibrium is generated therein;

expansion means located external and adjacent to said single closed fluid loop and in fluid communication with said single closed fluid loop for adaptively receiving at least a portion of said generated bubbles; and, a radiator coupled to a second portion of said single closed fluid loop offset from said first portion, said radiator radiating heat generated within said single closed fluid loop.

* * * * *